US005525120A

United States Patent [19]

Zauns–Huber et al.

[11] Patent Number: 5,525,120

[45] Date of Patent: Jun. 11, 1996

[54] DEGREASING PROCESS

[75] Inventors: Rudolf Zauns–Huber, Duesseldorf; Alfred Meffert, Monheim; Klaus Herrmann, Monheim; Wolfgang Prinz, Monheim; Fredi Wolter, Moenchen-Gladbach, all of Germany

[73] Assignee: Henkel Kommanditgesellschaft auf Aktien, Duesseldorf, Germany

[21] Appl. No.: 302,729

[22] PCT Filed: Mar. 9, 1993

[86] PCT No.: PCT/EP93/00527

§ 371 Date: Sep. 12, 1994

§ 102(e) Date: Sep. 12, 1994

[87] PCT Pub. No.: WO93/18188

PCT Pub. Date: Sep. 16, 1993

[30] Foreign Application Priority Data

Mar. 12, 1992 [DE] Germany ..... 42 07 806.7
Jan. 21, 1993 [DE] Germany ..... 43 01 553.0

[51] Int. Cl.[6] ..... C14C 1/08; C14C 5/00; C11D 1/825

[52] U.S. Cl. ..... 8/94.18; 8/94.21; 8/94.22; 8/94.23; 252/8.57; 252/174.21; 252/174.22

[58] Field of Search ..... 8/94.15, 94.18, 8/94.33, 94.21, 94.22, 94.23, 139; 252/8.57, 174.21, 351, 174.22

[56] References Cited

U.S. PATENT DOCUMENTS

| | | | |
|---|---|---|---|
| 3,086,944 | 4/1963 | Wedell | 252/318 |
| 4,288,339 | 9/1981 | Wilsberg | 252/90 |
| 5,246,147 | 11/1993 | Houghton et al. | 252/174.22 |
| 5,364,552 | 11/1994 | Merz et al. | 252/174.22 |

FOREIGN PATENT DOCUMENTS

| | | |
|---|---|---|
| 0448948 | 10/1991 | European Pat. Off. . |
| 2303850 | 10/1976 | France . |
| 2311848 | 12/1976 | France . |
| 0759631 | 5/1953 | Germany . |
| 2522902 | 11/1976 | Germany . |
| 2011944 | 7/1979 | United Kingdom . |
| 1549023 | 7/1979 | United Kingdom . |

OTHER PUBLICATIONS

Fat Sci. Technol. 1991, No. 1, pp. 13–19 (Month Unknown).

*Primary Examiner*—Prince Willis, Jr.
*Assistant Examiner*—Alan D. Diamond
*Attorney, Agent, or Firm*—Ernest G. Szoke; Wayne C. Jaeschke; Daniel S. Ortiz

[57] ABSTRACT

The invention is a process for degreasing animal skins in which the animal skin to be degreased is contacted with a mixture of a predominantly saturated $C_{12}$–$C_{18}$ fatty alcohol ethoxylate having an average of not more than 15 EO groups and a predominantly saturated $C_{6-10}$ fatty alcohol ethoxylate having an average of not more than 3 EO groups.

21 Claims, No Drawings

DEGREASING PROCESS

This application is a 371 of PCT/EP93/00527 filed Mar. 9, 1993.

FIELD OF THE INVENTION

This invention relates to degreasing preparations based on nonionic emulsifiers of the fatty alcohol ethoxylate type for the treatment of skins, pelts, hides, leathers and the like.

RELATED ART

In the production of leathers and furs, the use of nonionic surfactants or surfactant mixtures and solutions thereof in selected auxiliary liquids, more particularly organic solvents, is of considerable importance in a number of process steps where products belonging to the classes in question are used. Compounds of this type are used in particular in the degreasing of pelts, for example in the treatment of sheepskins, and quite generally for surface degreasing or thorough cleaning in the soaking, liming and bating steps and also in other steps involved in the manufacture of leathers and furs.

Known nonionic emulsifiers of the type in question are addition compounds of ethylene oxide and/or propylene oxide with alkylphenols, fatty alcohols or fatty acids. The importance of the class of compounds in question lies inter alia in the fact that nonionic emulsifiers of the described type have hardly any capacity for attachment to the skin or leather fibers. Accordingly, they are able optimally to perform their function of solubilizing sebum without being impeded by interaction with the skin itself.

One of the hitherto most commonly used compounds of this class of surfactants belongs to the group of alkylphenol ethoxylates. The compound in question is nonylphenol ethoxylate which contains an average of 10 EO groups and which is marketed under a variety of names for the particular application in question. The desired result in regard to the degreasing of skins and/or pelts is optimally achieved. Nevertheless, there is concern about the continued use of this compound. Its degradation products can lead to problems in biological stages of sewage treatment plants.

Experts have for some time developed comparable products based on fatty alcohol alkoxylates which are capable of at least partly fulfilling the required performance profile, but are less problematical in terms of wastewater treatment than the aromatic alkyl compounds mentioned above.

Thus, German patent application DE-OS 25 22 902 describes degreasing preparations containing nonionic and/or anionic surfactants as auxiliaries. Example 1 specifically discloses a mixture containing 10% by weight of an anionic surfactant (alkyl benzenesulfonate), 10% by weight of alcohol-based solvent (isopropyl alcohol), 20% by weight of an adduct of 10 moles of ethylene oxide with $C_{12/18}$ fatty alcohol and 20% by weight of an adduct of 3 moles of ethylene oxide with $C_{10/12}$ fatty alcohol. However, a degreasing process based on a mixture such as this could never be satisfactory on account of the large number of auxiliaries required. In addition, increasing environmental awareness dictates that the use of anionic surfactants and the use of solvents should be avoided as far as possible.

BRIEF DESCRIPTION OF THE INVENTION

However, the requirement profile which the degreasing preparations according to the invention are expected to satisfy is not confined to their outstanding capacity for emulsifying and dispersing fats, fatty acids, metal soaps and/or waxes and soil residues of all kinds; on the contrary, there are a number of other requirements to be satisfied. The degreasing preparations should be readily removable from the skin by washing and should not enter into any unwanted interactions with other anionic, cationic and/or nonionic substances, for example dyes and fat liquors. They should also show adequate electrolyte stability and, in particular, should be unaffected by water hardness, more particularly by high degrees of water hardness. Finally, the degreasing preparations should be usable both at acidic and at alkaline pH values.

Accordingly, the problem addressed by the present invention was to provide an optimized degreasing preparation based on nonionic fatty alcohol alkoxylates which would be widely usable under various conditions with optimal results.

According to the invention, the solution to this problem lies in the specific choice and blending of various active-substance components which, overall, may be assigned in terms of constitution to a class of compounds showing optimal biological compatibility.

Accordingly, the present invention relates to degreasing preparations based on nonionic emulsifiers of the fatty alcohol alkoxylate type for the treatment of skins, pelts, hides, leathers and the like, containing a mixture of (a) $C_{12-18}$ fatty alcohol ethoxylates containing on average more than 6 EO groups in the molecule and (b) head-fractionated fatty alcohol ethoxylates containing no more than 3 EO groups in the molecule, with the proviso that i) the fatty alcohols on which components (a) and (b) are based have an iodine value below 20 and ii) component (b) is present in a quantity of about 2 to 20% by weight, based on the sum of (a) and (b).

DETAILED DESCRIPTION OF THE INVENTION

Accordingly, the core of the teaching according to the invention lies in the combined use of selected medium- to long-chain fatty alcohol ethoxylates—class (a) compounds—and nonionic EO compounds—class (b) compounds—which are derived from so-called head-fractionated fatty alcohols.

It is known that so-called head-fractionated fatty alcohols are preferably linear representatives of the $<C_{12}$ range and, more particularly, the range from around $C_6$ to $C_{10}$. According to the invention, particular significance is attributed to the $C_8$ head-fractionated fatty alcohol and/or mixtures thereof with $C_{10}$ head-fractionated fatty alcohols.

According to the invention, ethoxylates of alcohols with carbon chain lengths in the ranges mentioned and with an iodine value below 20 are used both in the compounds of class (a) and in compounds of class (b). The choice of the method used to determine the iodine value is of minor importance. For the purposes of the present invention, however, reference is specifically made to the methods of Hanus-and Wijs, which have long been part of section C-V of the "DGF-Einheitsmethoden", and to Fiebig's more recent equivalent method (cf. Fat Sci. Technol. 1991, No. 1, pages 13–19).

A particularly preferred embodiment of the invention is characterized by the use of representatives of classes (a) and (b) where the iodine value of the basic fatty alcohol is below 5 and, more particularly, below 3. The feature of the iodine value is intended to illustrate the fact that the teaching according to the invention is directed to mixtures of representatives of classes (a) and (b) where the basic fatty alcohols are predominantly saturated.

Among the alcohols on which components (a) and (b) are based, particular significance is attributed to those of natural origin. It is known that the corresponding alcohols of vegetable and/or animal origin can be obtained from the associated fatty acids of vegetable and/or animal origin by hydrogenation. The alcohols in question are at least by far predominantly alcohols or alcohol mixtures with an even number of carbon atoms. Accordingly, ethoxylates of the corresponding linear, saturated $C_{12}$, $C_{14}$, $C_{16}$ and $C_{18}$ alcohols are particularly suitable for use as component (a). Mixtures of these types of alcohols are preferred as parent substances for the ethoxylates (a). The most important alcohol component of the class (b) compounds is head-fractionated $C_8$ fatty alcohol.

Component (a) selected as an effective fat emulsifier makes up the larger part of the degreasing preparation according to the invention based on the mixture of (a) and (b). The smaller part made up by component (b) amounts to between 2 and 25% by weight, based on the sum of (a) and (b). The range from 5 to 22% by weight is particularly preferred.

According to the invention, component (b) performs an important function, more particularly as a dispersion aid which facilitates the uptake and emulsification of fats, waxes and the like by the main active-substance components of the class (a) compounds according to the invention. The combined use of predominant quantities of the emulsifiers (a) and small quantities of the dispersants (b) is crucial to the improved result achieved in accordance with the invention.

In one preferred embodiment, the achievement of these objectives is further assisted by a certain choice of components (a). In this embodiment of the invention, mixtures of fatty alcohol ethoxylates differing in their average EO degrees are used as component (a). The range of on average up to 15 EO units per molecule of the fatty alcohol is preferably not exceeded.

In one important embodiment, mixtures of the following subclasses (a1) and (a2) are used in the class of components (a):

(a1): saturated $C_{12-18}$ fatty alcohol ethoxylates with an average EO degree of 6 to 10 and more particularly 6 to 8

(a2): $C_{12-18}$ fatty alcohol ethoxylates with an average EO degree of 9 to 15 and, more particularly, 9 to 12.

It has proved to be useful in this regard to use the components of subclass (a1) in larger quantities than the corresponding emulsifiers of subclass (a2) for this subcombination of emulsifiers belonging to the class (a) compounds. Components (a1) and (a2) are preferably used in mixing ratios of at least 2:1.

The average degree of ethoxylation of components (b) is distinctly lower than in emulsifier components (a1) and/or (a2) commensurate with the shorter chain length of the basic alcohol component in this case. Head-fractionated $C_8$ fatty alcohol ethoxylates with an average degree of ethoxylation of 1.5 to 2.5 are preferably used as the dispersant component (b).

According to the invention, particularly suitable active-substance mixtures contain, for example, 55 to 70% by weight of emulsifier component (a1) together with 20 to 30% by weight of emulsifier component (a2) in addition to small quantities of dispersant component (b). As already mentioned, the lower limit to the active-substance components (b) is approximately 2% by weight, based on the sum of components (a) and (b), although at least 5% by weight of component (b) is preferably present in the mixture of active substances.

It is a particular advantage of the degreasing preparations according to the invention that good results can even be obtained without the use of additional solvents, for example in the degreasing of pelts. In practice, the combination of dispersants and emulsifiers has a fat-dissolving and fat-dispersing effect in soaking and liming and, quite generally, in degreasing. The steps involved, for example, in soaking and liming are accelerated by the use of the degreasing preparations according to the invention.

In another preferred embodiment, the degreasing preparations according to the invention may contain other special selected solvents. Although, basically, any solvents capable—by their combined action—of adequately dissolving, emulsifying and/or dispersing the auxiliaries or rather the fats and waxes to be taken up from the skin may be used, special selection criteria are useful and preferred for the purposes of the invention:

Solvents in the context of the invention are, in particular, corresponding organic, water-immiscible or substantially water-immiscible liquids distinguished by sufficiently high flash points (usually above 100° C.). Suitable solvents liquid at room temperature are corresponding organic components characterized by biodegradability.

Suitable biodegradable liquid phases are, quite generally, carboxylic acid esters and, in particular, esters of monobasic carboxylic acids with monohydric alcohols, high-boiling ethers, corresponding oleophilic alcohols liquid at room temperature and/or carbonic acid esters. It can be useful in this regard—particularly among the class of carbonic acid esters—to select representatives of unsaturated components on the side of the ester-forming carboxylic acids and/or ester-forming alcohols. The unsaturated ester-forming components in question are preferably compounds liquid at room temperature, so that small quantities of the ester-based auxiliary liquids remaining behind in the skin or leather structure do not lead to any unwanted paraffin-like deposits, even after any subsequent saponification or partial saponification.

The quantity of biodegradable solvent used may vary within wide limits and, for example, may make up from 5 to 95% by weight of the mixture. The mixture of components (a) and (b) preferably makes up 5 to 90% by weight of these solvent-containing preparations. Corresponding solutions containing 10 to 60% by weight of components (a) and (b) in a biodegradable solvent or solvent mixture are particularly suitable. The percentages by weight mentioned are all based on the product as a whole.

Suitable auxiliary solvents based on unsaturated esters are, in particular, compounds of corresponding olefinically unsaturated higher fatty acids, for example oleic acid, with optionally unsaturated higher fatty alcohols, more particularly oleyl alcohol. Examples of the alcohol-based solvent phase are Guerbet alcohols, more particularly in the range up to $C_{20}$. The choice of ethers and, in particular, oleophilic alcohols liquid under normal conditions can lead to improved results in regard to the hydrolysis stability of the biodegradable solvent used as the auxiliary liquid phase.

EXAMPLES

To determine the particular degreasing effect, pickled sheepskins are cut along the spinal line. The right-hand and left-hand halves are identified as belonging to one another, after which—in separate processes—one half is processed using the degreasing preparations according to the invention while the other half is processed using known standard or comparison products from the field of degreasing preparations. The following procedure is adopted:

Procedure for testing degreasing preparations

Starting material: pickled English domestic sheepskins

Percentages based on pickled weight

Initial pH: approximately 1.8

Cut the skins along the spinal lines. Mark right-hand and left-hand halves (at the neck). Process the right-hand half with the test product and the left-hand half with the standard or comparison product.

| Step | % by wt. | Product/ remarks | °C. | Running time in mins. | pH value |
|---|---|---|---|---|---|
| Degreasing | 6 | Degreasing preparation | | | |
| | | Water so that both together give a 30% liquor | 35 | | |
| | | Running time | | 60 | |
| Pretanning | +3 | Sodium aluminium silicate (commercial product "Coratyl G") | | | |
| | 0.3 | Dicarboxylic acid (commercial product "Coratyl S") | | 60 | |
| | +2 | Chrome syntan (commercial product "Tannesco HN") | | | |
| | 0.2 | Dicarboxylic acid (commercial product "Coratyl S") | | | 5 |
| | +20 | Water | 35 | 60 | 3.8 |
| | +50 | Water | 40 | 30 | |
| | +100 | Water | 40 | 30 | 4.0 |
| | | Drain off liquor | | | |
| Washing | 300 | Water | 40 | 15 | |
| | | Drain off liquor | | | |
| | 300 | Water | 40 | 15 | |
| | | Drain off liquor | | | |
| | 300 | Water | 40 | 15 | |
| | | Drain off liquor | | | |
| | 300 | Water | 20 | 15 | |

Hoard up leather overnight, sammy, tenter and dry at 25° C. Cut out material for fat determination at the DIN removal point and use to determine residual fats.

Degreasing was carried out in known manner with three different known degreasing preparations (tests a to c) and, for comparison, with a biodegradable degreasing preparation formulated in accordance with the invention (test d) under the same working conditions. In addition, it is clear from a comparison of example d) according to the invention with test e) that the quantity of the head-fractionated fatty alcohol ethoxylate is a critical feature.

The individual results obtained in several tests are set out in Table 1 below; the natural fat content of the skins used (i.e. before degreasing) was 23 to 27% by weight.

TABLE 1

| No. | Degreasing preparation used | | Residual fat content after degreasing (in % by weight) |
|---|---|---|---|
| a) | 15% by weight | organic solvent (petroleum) | 4.0–6.0 |
| | 1.5% by weight | NP-10 | |
| b) | 6% by weight | NP-10 | 4.0–5.0 |
| c) | 6% by weight | mixture of NP-10 with organic solvent (isopropyl alcohol) | 3.0–4.0 |
| d) | 6% by weight | product mixture of 90% Dehydol-LS7 and 10% C8-1EO | 2.7–3.9 |

TABLE 1-continued

| No. | Degreasing preparation used | | Residual fat content after degreasing (in % by weight) |
|---|---|---|---|
| e) | 6% by weight | product mixture of 70% Dehydol-LS7 and 30% C8-1EO | 4.8–5.9 |

Abbreviations in Table 1:
NP-10: Adduct of 10 moles of ethylene oxide with 1 mole of nonylphenol
Dehydol LS7: Adduct of 7 moles of ethylene oxide with 1 mole of $C_{12/14}$ fatty alcohol (a product of Henkel KGaA, Düsseldorf)
C8-1EO: Adduct of 1 mole of ethylene oxide with 1 mole of $C_8$ fatty alcohol (octanol)

We claim:

1. A process for degreasing skins, pelts, hides and leathers which comprises: contacting the skins, pelts, hides and leathers to be degreased with a composition comprising (a) a $C_{12-18}$ fatty alcohol ethoxylate containing, on average, more than 6 EO groups in the molecule; and (b) a head-fractionated fatty alcohol ethoxylate containing not more than 3 EO groups in the molecule, wherein, i) the fatty alcohol residues in components (a) and (b) have an iodine value below 20 and ii) component (b) is present in an amount of from about 2 to 25% by weight, based on the weight of (a) and (b).

2. The process of claim 1, wherein (a) comprises a mixture of at least two fatty alcohol ethoxylates having different average number of EO groups, with a maximum average of 15 EO groups.

3. The process of claim 1 wherein component (b) comprises a head-fractionated $C_8$ fatty alcohol ethoxylate with an average number of EO groups of 1.5 to 2.5.

4. The process of claim 1 wherein component (a) comprises a mixture of, (a1) a saturated $C_{12-18}$ fatty alcohol ethoxylate with an average of 6 to 8 EO groups and (a2) a saturated $C_{12-18}$ fatty alcohol ethoxylate with an average of about 9 to 12 EO groups.

5. The process of claim 1 wherein components (a) and (b) are dissolved in a biodegradable solvent, liquid at room temperature, comprising at least one member selected from the group consisting of carboxylic acid esters, ethers, alcohols and carbonic acid esters wherein the solvent has a flash point above 100° C.

6. The process of claim 5, wherein components (a) and (b) are present in the biodegradable solvent in an amount of 5 to 90% by weight, based on the weight of (a), (b) and the biodegradable solvent.

7. The process of claim 5 wherein the solvent comprises at least one member selected from the group consisting of Guerbet alcohols and higher olefinically unsaturated fatty alcohols.

8. The process of claim 2 wherein the fatty alcohol ethoxylate comprise an average of up to 10 EO groups.

9. The process of claim 4 wherein the mixing ratio of component (a1) to component (a2) is not lower than 2:1.

10. The process of claim 6 wherein the components (a) and (b) are present in the biodegradable solvent in an amount of 10 to 60 percent by weight based on the weight of (a), (b) and the biodegradable solvent.

11. The process of claim 2 wherein component (b) comprises a head-fractionated $C_8$ fatty alcohol ethoxylate with an average number of EO groups of 1.5 to 2.5.

12. The process of claim 2 wherein component (a) comprises a mixture of, (a1) a saturated $C_{12-18}$ fatty alcohol ethoxylate with an average of 6 to 8 EO groups and (a2) a saturated $C_{12-18}$ fatty alcohol ethoxylate with an average of about 9 to 12 EO groups.

13. The process of claim 2 wherein components (a) and (b) are dissolved in a biodegradable solvent, liquid at room temperature, comprising at least one member selected from the group consisting of carboxylic acid esters, ethers, alcohols and carbonic acid esters wherein the solvent has a flash point above 100° C.

14. The process of claim 13 wherein components (a) and (b) are present in the biodegradable solvent in an amount of 5 to 90% by weight, based on the weight of (a), (b) and the biodegradable solvent.

15. The process of claim 13 wherein the solvent comprises at least one member selected from the group consisting of Guerbet alcohols and higher olefinically unsaturated fatty alcohols.

16. The process of claim 3 wherein component (a) comprises a mixture of, (a1) a saturated $C_{12-18}$ fatty alcohol ethoxylate with an average of 6 to 8 EO groups and (a2) a saturated $C_{12-18}$ fatty alcohol ethoxylate with an average of about 9 to 12 EO groups.

17. The process of claim 3 wherein components (a) and (b) are dissolved in a biodegradable solvent liquid at room temperature comprising at least one member selected from the group consisting of carboxylic acid esters, ethers, alcohols and carbonic acid esters wherein the solvent has a flash point above 100° C.

18. The process of claim 17 wherein components (a) and (b) are present in the biodegradable solvent in an amount of 5 to 90% by weight, based on the weight of (a), (b) and the biodegradable solvent.

19. The process of claim 17 wherein the solvent comprises at least one member selected from the group consisting of Guerbet alcohols and higher olefinically unsaturated fatty alcohols.

20. The process of claim 4 wherein components (a) and (b) are dissolved in a biodegradable solvent, liquid at room temperature, comprising at least one member selected from the group consisting of carboxylic acid esters, ethers, alcohols and carbonic acid esters wherein the solvent has a flash point above 100° C.

21. A degreasing composition for the degreasing of skins, pelts, hides and leathers comprising a mixture of (a) $C_{12-18}$ fatty alcohol ethoxylate containing an average of more than 6 EO groups in the molecule; and (b) a head-fractionated fatty alcohol ethoxylate containing an average of not more than 3 EO groups in the molecule; wherein, i) the fatty alcohol residues in components (a) and (b) have an iodine value below 20 and ii) component (b) is present in an amount of about 2 to 25% by weight, based on the weight of (a) and (b); wherein iii) component (b) comprises a head-fractionated $C_8$ fatty alcohol ethoxylate with an average number of EO groups of 1.5 to 2.5 and optionally iv) (a) comprises a mixture of (a1) a saturated $C_{12-18}$ fatty alcohol ethoxylate with an average of 6 to 8 EO groups, and (a2) a saturated $C_{12-18}$ fatty alcohol ethoxylate with an average of about 9 to 12 EO groups, the mixing ratio between components (a1) and (a2) being not less than 2:1, and optionally v) components (a) and (b) comprise a solution in a biodegradable solvent, liquid at room temperature, selected from the group consisting of carboxylic acid esters, ethers, alcohols and carbonic acid esters having a flash point above 100° C., components (a) and (b) being present in an amount of 5 to 90% by weight, based on the weight of (a) and (b) and the biodegradable solvent.

* * * * *